United States Patent [19]

Stackhouse et al.

[11] Patent Number: 4,705,653

[45] Date of Patent: Nov. 10, 1987

[54] SPLASH BAR FOR COOLING TOWER FILL ASSEMBLY

[75] Inventors: David W. Stackhouse; Stephen C. Heidl, both of Sebastopol, Calif.

[73] Assignee: Research-Cottrell, Inc., Bedminster, N.J.

[21] Appl. No.: 792,034

[22] Filed: Oct. 28, 1985

[51] Int. Cl.[4] ..... B01D 47/00

[52] U.S. Cl. ..... 261/111; 261/DIG. 11

[58] Field of Search ..... 261/111, DIG. 11; 52/584, 738, 630, 720, 180

[56] References Cited

U.S. PATENT DOCUMENTS

| | | | |
|---|---|---|---|
| 2,742,121 | 4/1956 | Liskey, Jr. | 52/180 |
| 3,044,237 | 7/1962 | Mart | 55/257 |
| 3,116,950 | 1/1964 | Chiegei et al. | 52/588 |
| 3,187,853 | 6/1965 | Glaser | 52/377 |
| 3,368,315 | 2/1968 | Thurnau | 52/588 |
| 3,389,895 | 6/1968 | De Flon | 261/111 |
| 3,468,521 | 9/1969 | Furlong et al. | 261/111 |
| 3,647,191 | 3/1972 | Fordyce | 261/111 |
| 4,020,130 | 4/1977 | Ovard | 261/111 |
| 4,133,851 | 1/1979 | Ovard | 261/111 |
| 4,181,691 | 1/1980 | Cates et al. | 261/111 |
| 4,439,378 | 3/1984 | Ovard | 261/111 |
| 4,512,937 | 4/1985 | Hoffmann | 261/111 |
| 4,515,735 | 5/1985 | Phelps | 261/111 |
| 4,578,227 | 3/1986 | Ovard | 261/111 |

*Primary Examiner*—Bernard Nozick

[57] ABSTRACT

A splash bar for use in crossflow cooling tower fill assemblies. The splash bar has (1) a substantially horizontal upper surface, (2) two downwardly extending side surfaces terminating at their lower edges in substantially horizontal inwardly directed flanges, and (3) at least one downwardly extending rib intermediate the side surfaces and terminating at its lower edge in a substantially horizontal flange. All of the flanges are in the same substantially horizontal plane, and all are spaced from one another to facilitate extrusion of the splash bar and to prevent accumulation of water and debris in the splash bar. The upper surface may be perforate or imperforate.

13 Claims, 6 Drawing Figures

SPLASH BAR FOR COOLING TOWER FILL ASSEMBLY

BACKGROUND OF THE INVENTION

This invention relates to splash bars utilized in the fill assemblies of crossflow cooling towers.

Splash bars for cooling falling liquid in crossflow cooling towers are well known and have various configurations. To optimize splashing and cooling, it is desirable to maximize the horizontal surface of the splash bar upon which falling liquid impinges. A large horizontal surface leads to structural support problems, however, as the thin horizontal surfaces of these splash bars are unable to withstand the force of faling liquid coupled with the weight of wetting liquid. To provide the required additional structural support, many splash bar designs have thin rib sections which extend below the horizontal surface of these splash bars.

Splash bars are typically held in the proper position and orientation within the fill assembly by being inserted through aligned openings in a series of grids within the cooling tower. These openings are formed by intersecting vertical and horizontal wires. The thin horizontal wires upon which the splash bars rest tend to damage the splash bars at the points of contact with the wires by means of abrasion resulting from force and vibration that are induced by falling liquid. Replacement of the damaged splash bars is time consuming and difficult, particularly because the cooling tower must be taken out of operation.

A closed box shape has been proposed in previous designs to alleviate these problems, but it has been found that a splash bar of that configuration is difficult to manufacture becaus it is difficult to extrude. Moreover, where perforations are provided in the horizontal surfaces of such splash bars to enhance splashing and to improve performance, waterborne debris tends to collect between the top and bottom surfaces of the splash bar, thereby adding weight and reducing the cooling capacity of the fill.

In view of the foregoing, it is an object of this invention to provide apparatus for providing sufficient structural strength for a splash bar to withstand the weight of large quantities of falling liquids which impinge upon a maximum horizontal surface for liquid splashing action.

It is another object of this invention to provide load bearing surfaces which will allow the splash bar to rest on a wire support without being damaged by abrasion at the points where the splash bar contacts the wire.

It is another object of this invention to increase manufacturing efficiency relative to the closed box shape which is difficult to extrude.

It is another object of this invention to provide an open bottom shape to prevent waterborne debris from accumulating inside a splash bar which has a pattern of holes punched into its horizontal splashing surface to improve cooling.

SUMMARY OF THE INVENTION

These and other objects of the invention are accomplished in accordance with the principles of the invention by providing a splash bar which is E-shaped in cross-section. The splash bar has a generally relatively wide horizontal surface that is structurally supported from below by two side sections and at least one rib section. The downwardly extending sides and ribs have flanges along their lengths at their lower edges to provide load bearing surfaces of sufficient width where they contact the horizontal wire supports to reduce the damage to the splash bar caused by abrasion. These various flanges are separated from each other by sufficient open spacing to prevent liquid and debris which pass through perforations in the horizontal surface from accumulating within the splash bar.

Further features of the invention, its nature and various advantages will be more apparent from the accompanying drawings and the following detailed description of the invention.

DETAILED DESCRIPTION OF THE INVENTION

Figure 1:
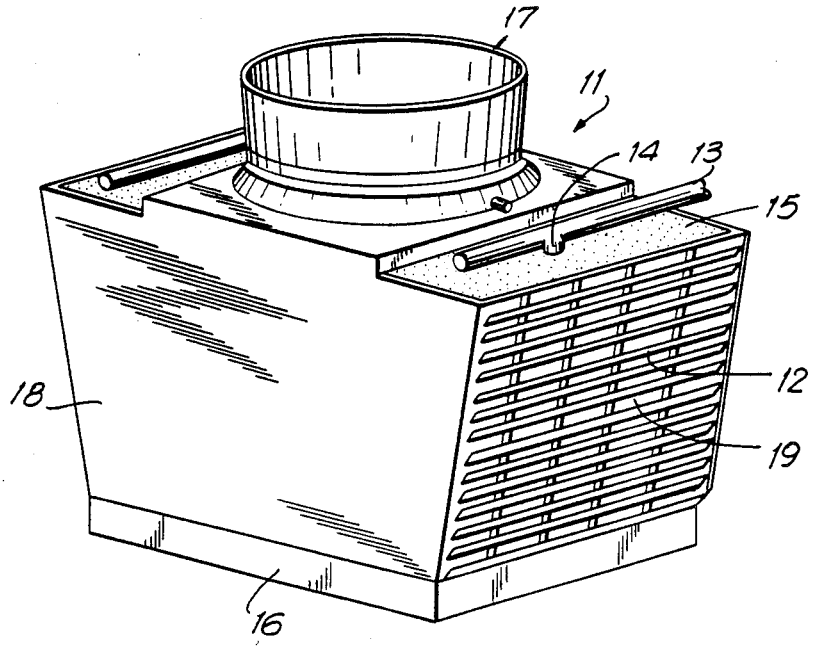
FIG. 1 is an isometric view of a typical mechanical draft crossflow water cooling tower.
Figure 2:
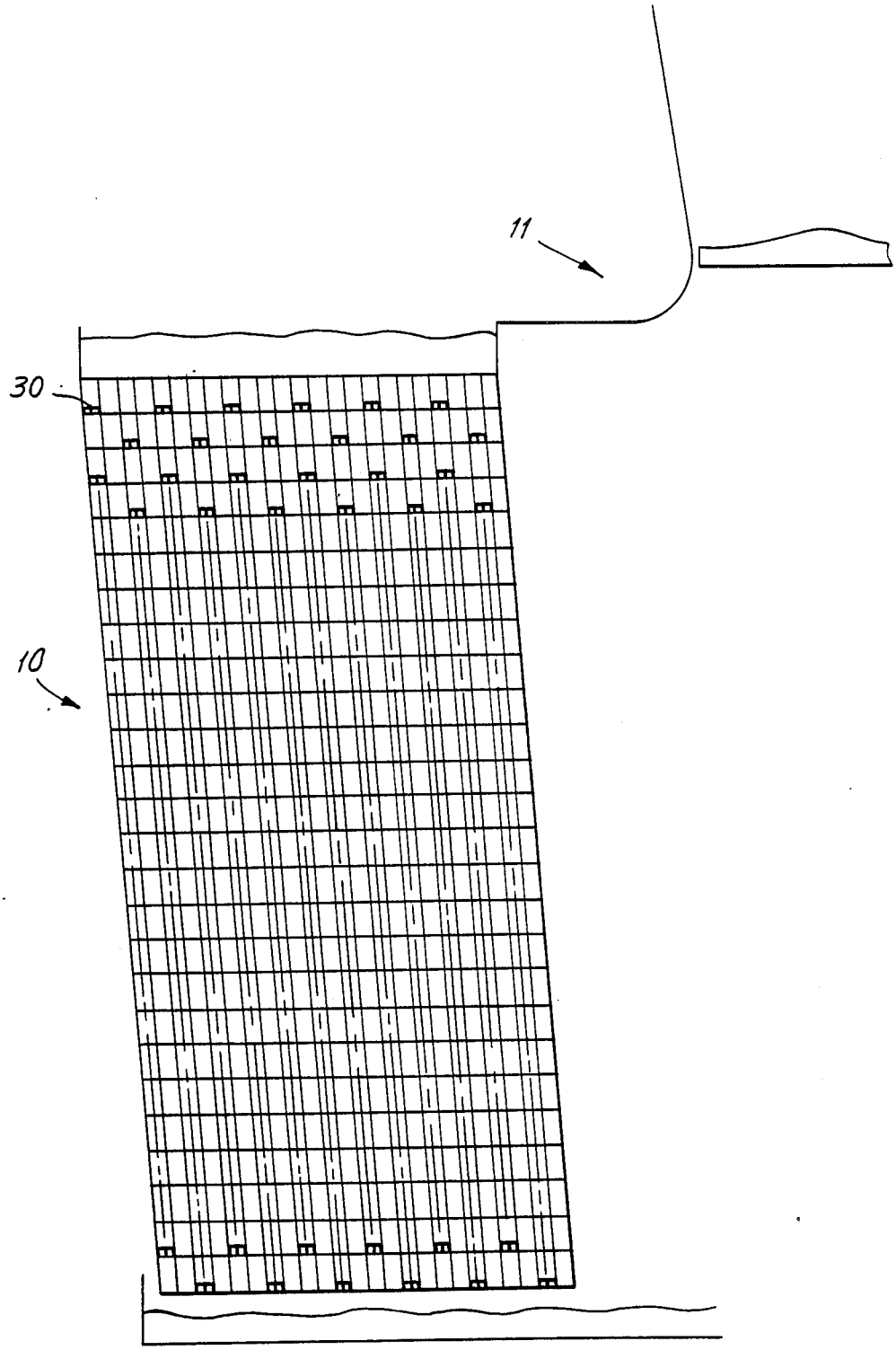
FIG. 2 is a vertical cross-sectional view of the crossflow cooling tower of FIG. 1 showing a portion of the fill assembly area along a single grid structure with E-shaped splash bars constructed in accordance with the principles of this invention in installed position.

A typical induced draft crossflow water cooling tower 11 is illustrated in FIG. 1 and has two opposite enclosed sides 18 and two opposite open sides 19. Open sides 19 constitute the air intake area. Louvers 12 are placed across open sides 19 of cooling tower 11 to prevent splashing liquid from escaping from fill assembly area 10, illustrated in FIG. 2, which is located within cooling tower 11. Louvers 12 further serve to reduce unwanted, random wind currents from affecting air flow within fill assembly 10.

Cooling tower 11 has hot liquid inlet 13, distributer valve 14, and hot liquid basin 15 including means for dispersing hot liquid into fill assembly area 10. Cold liquid basin 16 is located beneath fill assembly 10. Air flow is induced by a fan (not shown) located in fan cylinder 17. The air flows into open sides 19, then through fill assembly 10, and finally exits cooling tower 11 through fan cylinder 17.

Figure 3:
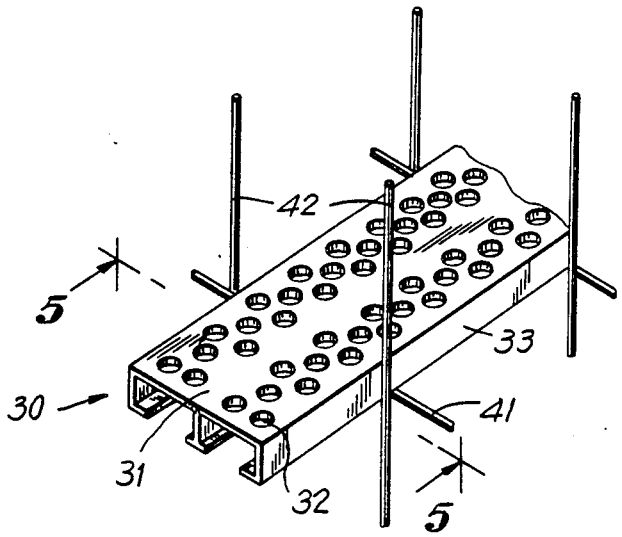
FIG. 3 is a perspective view of an E-shaped splash bar embodiment of this invention disposed on the support wire grid, with perforations formed into the horizontal surface of the splash bar and with one rib support section.

Splash bars 30 are positioned within fill assembly 10 by a series of openings formed by aligned grids of intersecting vertical and horizontal wires. Each grid is attached to cooling tower 11 by connecting means (not shown). Referring to FIG. 3, it can be seen that splash bar 30 rests in a grid opening formed by horizontal wire 41 and vertical wires 42. It is apparent that longitudinally extending splash bar 30 is supported and positioned by a series of such openings along its length.

A plurality of splash bars 30 are placed within fill assembly 10 longitudinally parallel to a common axis to form a matrix pattern. In the preferred orientation, the longitudinal axis of each splash bar is transverse to the induced air flow within fill assembly 10. Splash bars 30 may be placed within fill assembly 10 in any conventional pattern, such as the alternating pattern illustrated in FIG. 2.

Figure 5:
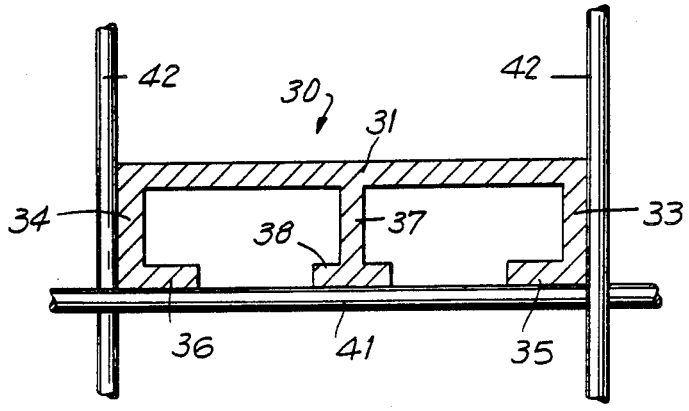
FIG. 5 is a sectional view taken along the line 5—5 in FIG. 3.
Figure 4:
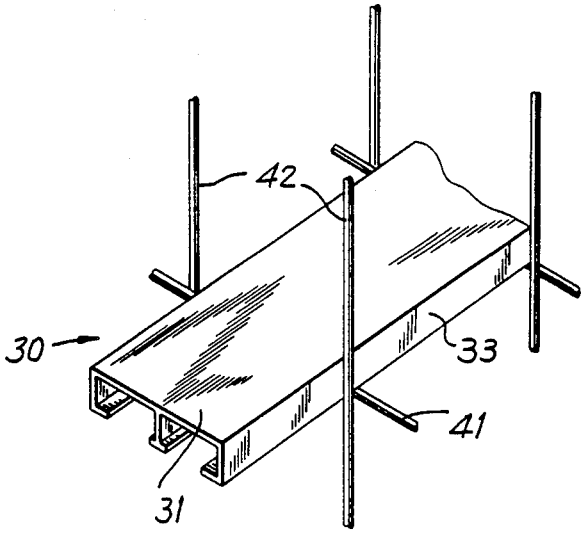
FIG. 4 is a perspective view of an E-shaped splash bar embodiment of this invention with an imperforate horizontal surface and a single rib support section.

A typical E-shaped splash bar 30 is illustrated in FIGS. 3 and 5. Splash bar 30 has a relatively wide horizontal surface 31 which is substantially planar for water splashing action. It is evident from FIGS. 3 and 5 that the maximum width of horizontal surface 31 is equal to the spacing between adjacent vertical wires 42. In the preferred embodiment, perforations 32 are formed in horizontal surface 31 (e.g., by punching or drilling) to improve cooling performance. Horizontal surface 31 may also be imperforate, as illustrated by the embodiment of splash bar 30 shown in FIG. 4.

Vertical sides 33 and 34 of splash bar 30 are attached at each edge of horizontal surface 31 and extend downward to provide structural support for horizontal surface 31. Inwardly directed flanges 35 and 36 are attached at the bottom edges of sides 33 and 34. Flanges 35 and 36 bear on the top of wire 41 to provide additional structural support for splash bar 30. Flanges 35 and 36 also provide increased load bearing surface where splash bar 30 contacts horizontal wire 41, thereby reducing the abrasion damage which is caused by force and vibration induced by falling liquid impinging upon horizontal surface 31.

Rib 37 extends below horizontal surface 31 between sides 33 and 34 to provide additional structural support for horizontal surface 31. Flange 38 is attached to rib 37 at the lower edge of rib 37. Flange 38 is transverse to rib 37 and bears on wire 41 to reduce the adverse effects of abrasion. Flange 38 also adds structural support for the splash bar. Adequate spacing is provided between flanges 35, 36, and 38 to allow liquid and debris which pass through perforations 32 to continue through fill assembly 10 without becoming lodged within splash bar 30.

Splash bar 30 is preferably manufactured by extruding rigid PVC to a thickness of about 0.046 inches. In the preferred embodiment, horizontal section 31 is 1.75 inches in width. Vertical sides 33 and 34 are 0.5 inches in height. Rib 37 is perpendicular to horizontal section 31 and is attached to the center of horizontal surface 31 midway between sides 33 and 34. The height of rib 37 is 0.5 inches. Flanges 35, 36, and 38 are each 0.25 inches in width, with flange 38 being centered about the plane of rib 37. This configuration is easier to extrude than a splash bar having a closed box shape and represents an efficient use of material to provide a maximum horizontal surface for water splashing action.

Figure 6:
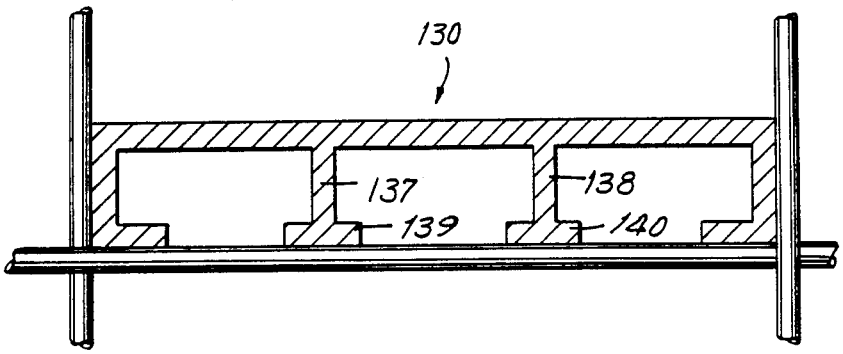
FIG. 6 is a sectional view of a splash bar embodiment of this invention with two rib support sections.

Although there is only one rib section 37 in the preferred embodiment of splash bar 30, it will be recognized that a greater number of rib sections can be attached at the underside of horizontal surface 31 to enhance the strength and resistance to abrasion of splash bar 30. FIG. 6 illustrates splash bar 130 which is identical in configuration to splash bar 30 except that splash bar 130 has a pair of ribs 137 and 138 with flanges 139 and 140 instead of the single rib 37 with flange 38 that are present in splash bar 30.

We claim:

1. A crossflow cooling tower fill assembly for allowing liquid to fall down through said fill assembly and for allowing cooling air to flow through the fill assembly transverse to the flow of said liquid in order to cool said liquid, said assembly comprising:

a plurality of longitudinal splash bars; and means for supporting said splash bars so that said splash bars are substantially horizontal and parallel to one another and arranged in a plurality of vertically spaced, substantially horizontal planes, the splash bars in each plane being horizontally spaced from one another to allow said liquid to fall down between said splash bars to the planes of splash bars below, each splash bar including a substantially horizontal, longitudinally extending top web member having (1) longitudinally extending, downwardly projecting vertical side web members, both of said side web members having a lower longitudinal edge with a longitudinally extending, inwardly projecting flange, and (2) at least one longitudinally extending, downwardly projecting rib web member between said side web members, each said rib web member having a lower longitudinal edge with a longitudinally extending, laterally projecting flange.

2. The apparatus defined in claim 1 wherein said top web member of at least some of said splash bars is perforate.

3. The apparatus defined in claim 1 wherein each splash bar has one rib web member.

4. The apparatus defined in claim 3 wherein said rib web member is longitudinally attached to said top web member of the associated splash bar along the center of said top web member.

5. The apparatus defined in claim 1 wherein each said rib web member is perpendicular to said top web member of the associated splash bar.

6. A crossflow cooling tower fill assembly for allowing liquid to fall down through said fill assembly and for allowing cooling air to flow through the fill assembly transverse to the flow of said liquid in order to cool said liquid, said assembly comprising:

a plurality of longitudinal splash bars; and means for supporting said splash bars so that said splash bars are substantially horizontal and parallel to one another and arranged in a plurality of vertically spaced, substantially horizontal planes, the splash bars in each plane being horizontally spaced from one another to allow said liquid to fall down between said splash bars to the planes of splash bars below, each splash bar including:

a substantially horizontal, longitudinally extending top web member;

two substantially vertical, longitudinally extending side web members, each of which is joined to the top web member along a respective one of the lateral edges of the top web member and extends downwardly from the top web member, and each of which has a substantially horizontal, longitudinally extending, laterally projecting flange joined to the lower edge of the associated side web member and extending inwardly from the associated side web member toward the flange on the other side web member; and at least one substantially vertical, longitudinally extending rib web member joined to the top web member intermediate the side web members, the rib web member extending downwardly from the top web member and having a substantially horizontal, longitudinally extending, laterally projecting flange joined to the lower edge of the rib web member.

7. The apparatus defined in claim 6 wherein the top web member of each splash bar defines a plurality of substantially vertical apertures extending through the top web member intermediate the side web members.

8. The apparatus defined in claim 6 wherein each splash bar is a unitary structure.

9. The apparatus defined in claim 6 wherein the splash bars in each plane below the topmost plane are horizontally offset from the splash bars in the plane immediately above.

10. The apparatus defined in claim 6 wherein all of the flanges of each splash bar are disposed in a common substantially horizontal plane.

11. The apparatus defined in claim 10 wherein said means for supporting said splash bars comprises a plurality of longitudinal support members, said support members being perpendicular to said splash bars and arranged in a plurality of vertically spaced substantially horizontal support planes, the support members in each support plane being horizontally spaced from one another, all of the flanges of each splash bar resting on the support members in an associated support member plane.

12. The apparatus defined in claim 10 wherein all of the flanges of each splash bar are spaced from one another in said common substantially horizontal plane.

13. The apparatus defined in claim 12 wherein the flange associated with each rib web member projects equidistantly from both sides of the rib web member.

* * * * *